US007190918B2

(12) United States Patent
Kimura et al.

(10) Patent No.: US 7,190,918 B2
(45) **Date of Patent: *Mar. 13, 2007**

(54) IMAGE FORMING APPARATUS

(75) Inventors: Yoshiyuki Kimura, Tokyo (JP); Hiroshi Ono, Tokyo (JP); Takeshi Shintani, Kanagawa (JP); Satoshi Hatori, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 12 days.

This patent is subject to a terminal disclaimer.

(21) Appl. No.: 11/052,802

(22) Filed: Feb. 9, 2005

(65) Prior Publication Data

US 2005/0129425 A1 Jun. 16, 2005

Related U.S. Application Data

(63) Continuation of application No. 10/401,554, filed on Mar. 31, 2003, now Pat. No. 6,885,836.

(30) Foreign Application Priority Data

Mar. 29, 2002 (JP) ..... 2002-094755
Feb. 26, 2003 (JP) ..... 2003-048760

(51) Int. Cl.
*G03G 21/20* (2006.01)

(52) U.S. Cl. ..... 399/91; 399/92; 399/94

(58) Field of Classification Search ..... 399/91, 399/92, 94, 97, 107, 110, 98, 122
See application file for complete search history.

(56) References Cited

U.S. PATENT DOCUMENTS 6,240,265 B1 * 5/2001 Noh ..... 399/92
2003/0053818 A1 3/2003 Kimura
2005/0129425 A1 6/2005 Kimura et al.

FOREIGN PATENT DOCUMENTS

| | | |
|---|---|---|
| JP | 3-55572 | 3/1991 |
| JP | 5-307283 | 11/1993 |
| JP | 8-194429 | 7/1996 |
| JP | 11-224036 | 8/1999 |
| JP | 2000-221867 | 8/2000 |
| JP | 2000-275975 | 10/2000 |
| JP | 2001-154507 | 6/2001 |
| JP | 2000-72833 | 3/2002 |
| JP | 2002-91123 | 3/2002 |
| JP | 2002-116598 | 4/2002 |
| JP | 2003-15494 | 1/2003 |

OTHER PUBLICATIONS

U.S. Appl. No. 11/269,717, filed Nov. 9, 2005, Fujimori et al.

* cited by examiner

*Primary Examiner*—Hoan Tran
(74) *Attorney, Agent, or Firm*—Oblon, Spivak, McClelland, Maier & Neustadt, P.C.

(57) ABSTRACT

An image forming apparatus of the present invention includes an image forming section configured to develop a latent image to thereby produce a corresponding toner image. An endless image transfer body directly or indirectly supports the toner image and conveys it while a fixing unit fixing the toner image. A module frame covers part of the image transfer body to thereby prevent heat generated by the fixing unit from being transferred to the image transfer body.

12 Claims, 3 Drawing Sheets

IMAGE FORMING APPARATUS

BACKGROUND OF THE INVENTION

1. Field of the Invention

The present invention relates to an image forming apparatus and more particularly to an image forming apparatus capable of protecting an image transfer body included in an image forming section from temperature elevation.

2. Description of the Background Art

An electrophotographic color image forming apparatus including either one of a single photoconductive drum or image carrier or a plurality of photoconductive drums arranged in tandem configuration is conventional. In a single drum type of apparatus, a plurality of developing units are arranged around the drum each for forming a toner image on the drum in a particular color. The resulting toner images of different colors are sequentially transferred from the drum to a sheet or recording medium one above the other, completing a color image on the sheet. In a tandem type of apparatus, a particular developing unit is assigned to each photoconductive drum for forming a toner image in a particular color on the drum. The resulting toner images of different colors are sequentially transferred from the drums to a sheet one above the other, also completing a color image. In the tandem type of apparatus, a fixing unit is positioned below an image transfer body in order to reduce the size of the apparatus in the direction of sheet conveyance, as taught in Japanese Patent Laid-Open Publication No. 11-224036. The tandem type of apparatus uses either one of an indirect image transfer system configured to transfer the color image to the sheet by way of an image transfer body and a direct image transfer system configured to directly transfer the toner image to the sheet being conveyed by an image transfer body.

In any case, the problem with the tandem type of apparatus is that even when, e.g., a space between the image transfer body and a fixing unit is exhausted for obstructing temperature elevation, hot air flows due to heat radiated via openings formed in the fixing unit. Such hot air is apt to heat part of the image transfer body and bring about uneven image transfer; this is the case when the toner image is directly transferred to the image transfer body. Further, it is likely that the curls of the portions of the image transfer body contacting rollers are aggravated by thermal stress. Such curls are apt to appear in the resulting image in the form of horizontal stripes when the color image is directly transferred to the image transfer body. Moreover, when the image transfer body conveys a sheet to which the color image is to be directly transferred, the former cannot stably convey the latter, also resulting in horizontal stripes mentioned above. In addition, heat effects the developing unit as well and is apt to bring about toner blocking and other problems, as known in the art.

Technologies relating to the present invention are also disclosed in, e.g., Japanese Patent Laid-Open Publication No. 2000-275975, 2001-154507, 2002-72833, 2002-91123 and 2003-15494.

SUMMARY OF THE INVENTION

It is an object of the present invention to provide an image forming apparatus capable of effectively preventing heat generated by a fixing unit from being transferred to an intermediate image transfer body to thereby protect the image transfer body and a developing unit from temperature elevation.

An image forming apparatus of the present invention includes an image forming section configured to develop a latent image to thereby produce a corresponding toner image. An endless image transfer body directly or indirectly supports the toner image and conveys it while a fixing unit fixing the toner image. A module frame covers part of the image transfer body to thereby prevent heat generated by the fixing unit from being transferred to the image transfer body.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
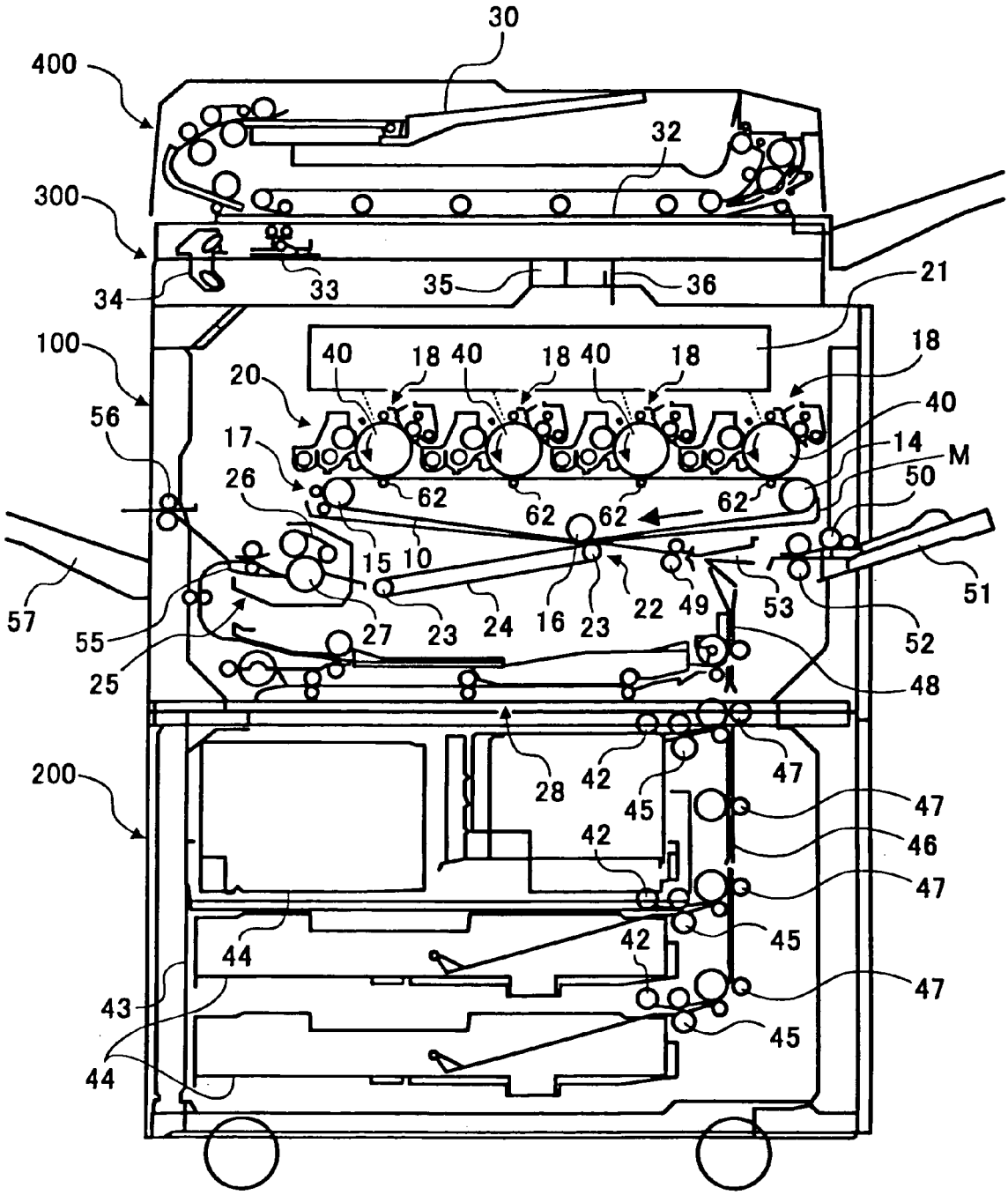
FIG. 1 is a view showing the general construction of an image forming apparatus embodying the present invention.

Referring to FIG. 1 of the drawings, an image forming apparatus embodying the present invention is shown and implemented as a tandem, color electrophotographic copier by way of example. As shown, the color copier is generally made up of an apparatus body 100, a sheet feed table 200 on which the copier body 100 is mounted, a scanner 300 mounted on the copier body 100, and an ADF (Automatic Document Feeder) 400 mounted on the scanner 300.

The copier body 100 includes an intermediate image transfer belt or endless intermediate image transfer body (simply belt hereinafter) 10 located at the center of the apparatus body 100. The belt 10 is passed over three rollers 14, 15 and 16 and is movable clockwise, as viewed in FIG. 1. In the illustrative embodiment, a belt cleaner or cleaning means 17 adjoins, among the rollers 14 through 16, the left roller 15 for removing toner left on the belt 10 after image transfer.

Black, yellow, magenta and cyan image forming means 18 are positioned above the upper run of the belt 10 between the rollers 14 and 15 and sequentially arranged in this order in the direction of sheet conveyance, constituting a tandem image forming section 20. An exposing unit 21 is positioned above the tandem image forming section 20.

A secondary image transferring device 22 is located below the belt 10 and includes an endless, secondary image transfer belt 24 passed over two rollers 23. A fixing unit 25 is positioned at one side of the secondary image transferring device 22 and is configured to fix a toner image transferred to a sheet. The fixing unit 25 includes a fixing belt 26 and a press roller 27 pressed against the belt 26.

The secondary image transferring device 22 additionally has a function of conveying a sheet to which a toner image is transferred by secondary transfer to the fixing unit 25. Of course, the secondary image transferring device 22 may be implemented as a transfer roller or a non-contact charger. In the illustrative embodiment, a sheet turning device 28 is arranged below the secondary image transferring device 22 and fixing unit 25 in order to turn a sheet in a duplex copy mode, so that images can be formed on both sides of the sheet.

Figure 2:
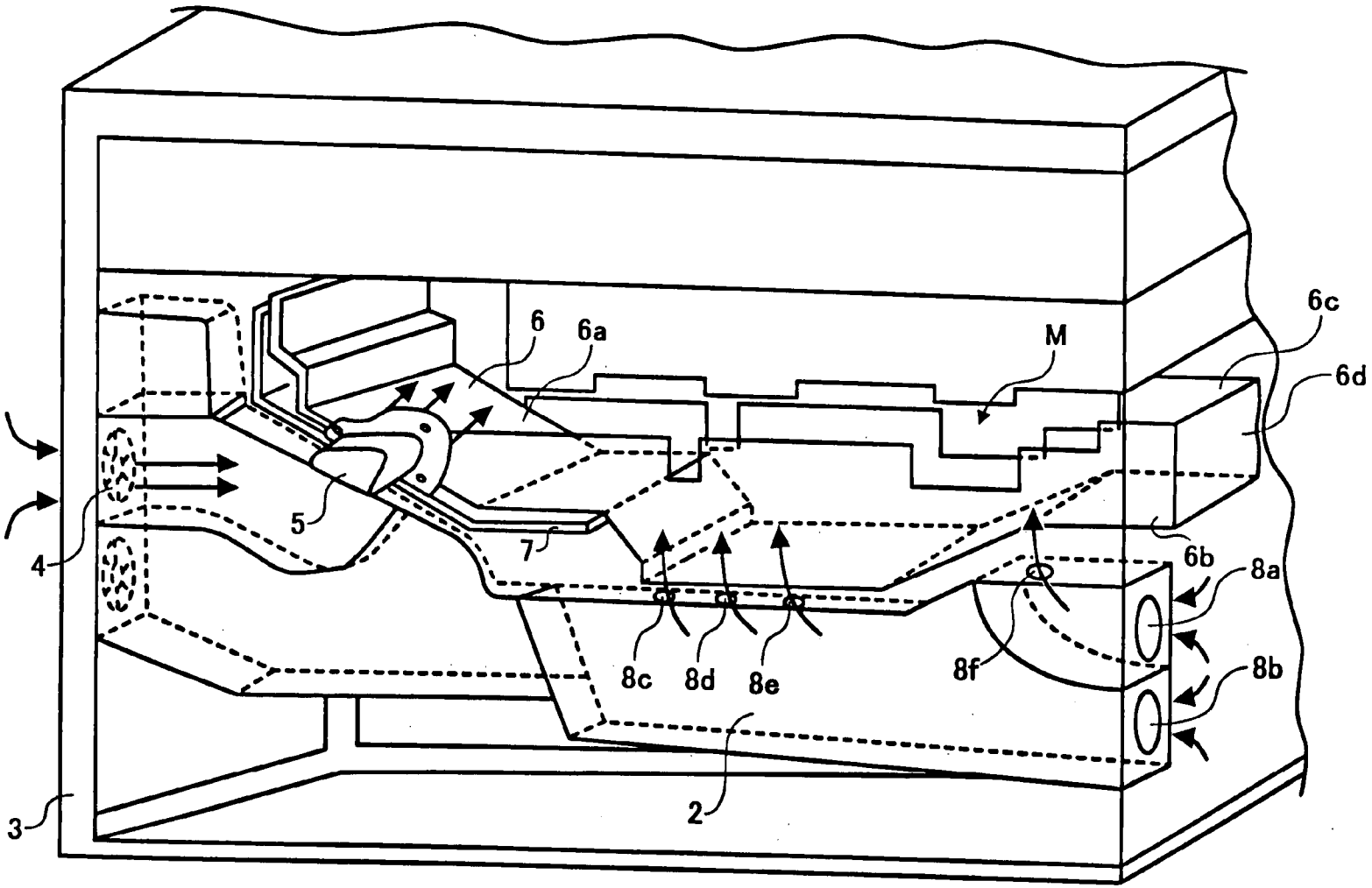
FIG. 2 is a perspective view showing a module frame included in the illustrative embodiment.
Figure 3:
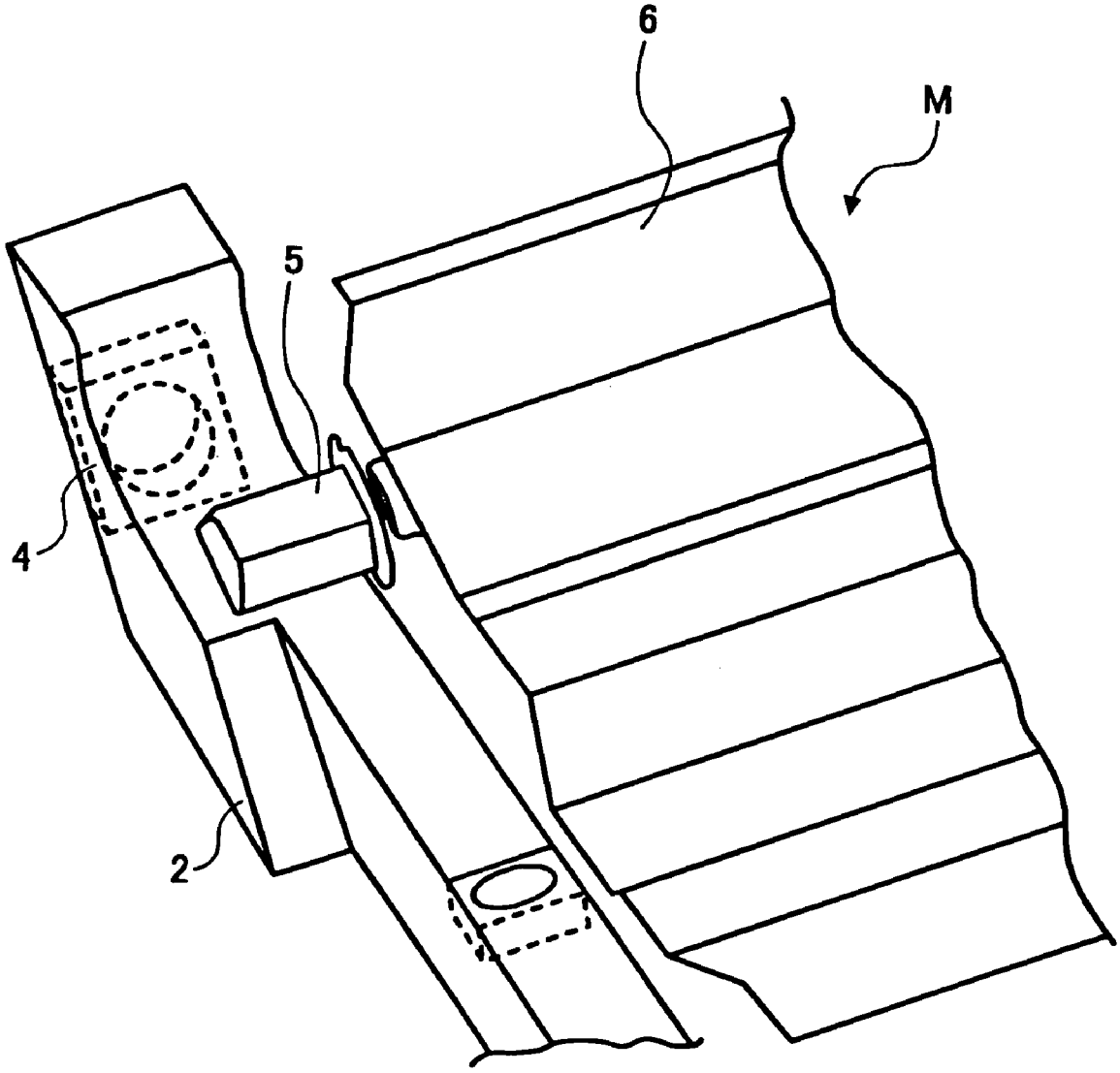
FIG. 3 is an enlarged perspective view showing part of the module frame.

Reference will be made to FIGS. 2 and 3 for describing a module frame M intervening between the belt 10 and the fixing unit 25 and characterizing the illustrative embodiment. As shown, the copier body 100 is provided with a body frame 3 implemented as a substantially rectangular parallelepiped frame and accommodating the belt 10, secondary image transferring device 22, a registration roller pair 49, the fixing unit 25 and so forth. The module frame M covers the belt 10 and is made up of a bottom wall or heat shield cover 6, a front side wall 6*b*, a rear side wall 6*c*, and a right side wall 6*d*. The module frame M can be pulled out of the copier body 100 together with the body frame 3.

A white plate 7 is fixed in place in the body frame 3 above the fixing unit 25 and implemented as an aluminum sheet. The white plate 7 is connected to a heat pipe, not shown, associated with the fixing unit 25 in order to discharge heat generated by the fixing unit 25. The heat pipe is connected to a heat sink not shown. Cool air outside the copier is blown against the heat sink for thereby cooling the fixing unit 25, so that heat is prevented from being transferred to the belt 10.

The heat shield cover 6 is formed of resin or similar material having low thermal conductivity. A heat insulating material 6*a* is provided on the surface of the heat shield cover facing the belt 10 or the fixing unit 25. If desired, two heat shield covers 6 may be provided in double-wall configuration for further enhancing heat insulation.

A ductwork 2 is mounted on the body frame 3, e.g., fastened to the right and left posts of the body frame 3 by screws at substantially the same level as the heat shield cover 6. The ductwork 2 includes a suction fan 4 positioned on the left side of the copier body 100. The suction fan 4 causes outside cool air to flow into the ductwork 2 when driven. Air flown into the ductwork 2 flows out via a nozzle 5 positioned in the upper portion of the ductwork 2. The nozzle 5 is mounted to the front side wall 6*b* at the position of the ductwork 5 adjacent the fixing unit 25. Air jetted via the nozzle 5 begins to flow through a space between the module frame M and the belt 10 right above the fixing unit 25 and a space between opposite runs of the belt 10 around the roller 15 and then flows in such a manner as to cool off the entire module frame M. This is because the position right above the fixing unit 25 is more susceptible to heat than the other positions inside the module frame M.

A first and a second suction port 8*a* and 8*b* are formed in the right side wall of the ductwork 2. Outside air flown into the ductwork 2 via the first suction port 8*a* is blown against the black or rightmost image forming means 18 via an opening 8*f* formed in the top of the ductwork 2. Outside air flown into the ductwork 2 via the second suction port 8*b* is blown against the yellow, magenta and cyan image forming means 18 via openings 8*c*, 8*d* and 8*e* also formed in the top of the ductwork 2.

The operation of the illustrative embodiment will be described hereinafter. In a color mode, the operator of the copier closes the ADF 400 and then stacks a document or documents on a document tray 30 included in the ADF 400. Subsequently, when the operator presses a start switch, not shown, the ADF 400 conveys one of the documents to a glass platen 32. After the document has been positioned on the glass platen 32, a first and a second carriage 33 and 34 included in the scanner 300 are caused to move. The first carriage 33 scans the document with light issuing from a light source while reflecting the resulting imagewise reflection from the document toward the second carriage 34. The second carriage 34 further reflects the incident imagewise light with a mirror and then focuses it on an image sensor 36 via a lens 35. The image sensor 36 transforms the incident light to a corresponding electric signal.

When the start switch is pressed, a motor, not shown, drives one of the rollers 14 through 16 over which the belt 10 is passed. As a result, the belt 10 starts running while causing the other rollers supporting it to rotate. At the same time, photoconductive drums or image carriers 40 included in the four image forming means 18 are rotated to form a black, a yellow, a magenta and a cyan toner image thereon. Such toner images are sequentially transferred to the belt 10 one above the other in accordance with the movement of the belt 10, completing a color image on the belt 10.

The sheet feed table 200 accommodates a sheet bank 43 including a plurality of sheet cassettes 44. When the start switch is pressed, as stated above, one of pickup rollers 42 assigned to designated one of the sheet cassettes 44 pays out a sheet from the sheet cassette 44. At this instant, a reverse roller 45 associated with the pickup roller 42 separates the other sheets underlying the sheet being paid out. The sheet thus paid out is introduced into a path 46 and then conveyed by roller pairs 47 to a registration roller pair 49 via a path 48, which is disposed in the copier body 100. The registration roller pair 49 once stops the sheet in order to correct skew. When special sheets are stacked on a manual feed tray 51, a pickup roller 50 assigned to the manual feed tray 51 pays out one sheet while a reverse roller 52 separates the other sheets underlying the sheet being paid out. The sheet so paid out is also conveyed to the registration roller pair 49 via a path 53.

The registration roller pair 49 starts conveying the sheet with timing such that the leading edge of the sheet meets the leading edge of the color image completed on the belt 10. When the sheet is brought to a nip between the belt 10 and the secondary image transferring device 22, the device 22 transfers the color image from the belt 10 to the sheet.

The sheet carrying the toner image thereon is conveyed to the fixing unit 25 by the secondary image transferring device 22. The fixing unit 25 fixes the color image on the sheet with heat and pressure. Subsequently, a path selector 55 is so positioned as to steer the sheet or copy to an outlet roller pair 56. The outlet roller pair 56 drives the sheet out of the copier body 100 to a copy tray 57. On the other hand, in a duplex copy mode, the path selector 55 is so positioned as to steer the sheet or simplex copy to the sheet turning device 28. The sheet turning device 28 turns the sheet and again feeds it to the nip between the belt 10 and the secondary image transferring device 22, so that another color image is transferred to the other side of the same sheet. The resulting duplex copy is also driven out to the copy tray 57 via the fixing unit 25 and outlet roller pair 56.

While the copier 100 is in operation, the fixing unit 25 generates heat. However, the heat shield cover 6 shields the heat and thereby prevents it from being transferred to the belt 10, preventing temperature around the belt 10 from rising.

Outside cool air is sucked into the duct 2 by the suction fan 4 and then jetted toward the belt 10 via the nozzle 5. Such air cools off the space around the belt 10 on the basis of heat exchange. The resulting hot air is exhausted via an exhaust port not shown. In this manner, temperature around the belt 10 is more effectively prevented from rising.

In the illustrative embodiment, the suction fan 4 is controlled in accordance with the operating condition of the copier body 200. Specifically, the temperature of part of the belt 10 is likely to rise in the stand-by state of the apparatus body 200 while the temperature inside the apparatus body 200 is apt to rise in a repeat copy mode. In light of this, the illustrative embodiment halves the rotation speed of the suction fan 4 in the stand-by state or maximizes the rotation speed of the fan 4 in a repeat copy mode or a duplex copy mode.

Further, the drive of the suction fan 4 may be controlled in accordance with the output of a sensor or sensing means responsive to the temperature around the belt 10, if desired. In such a case, when the temperature around the belt 10 rises, the rotation speed or the duration of rotation of the suction fan 4 will be increased to cause a great amount of cool air to flow into the space around the belt 10 for thereby effecting efficient heat exchange. This successfully protects the belt 10 from local temperature elevation for thereby obviating uneven image transfer and horizontal stripes and other image defects.

While the nozzle 5 is positioned in the vicinity of the fixing unit 25 in the illustrative embodiment, it may alternatively be positioned in the vicinity of the intermediate portion of the belt 10, i.e., above the roller 16 shown in FIG. 1. This configuration causes cool air to positively flow through the space between the opposite runs of the belt 10, so that the entire belt 10 can be efficiently cooled off. Further, the module frame M and heat shield cover 6 may be omitted, depending on the cooling effect available with the suction fan 4. For example, only the front side wall 6*b* provided with the nozzle 5 may be used in place of the module frame M. In this case, however, the belt 10 is more susceptible to heat generated by the fixing unit 25 because the heat-shield cover 6 is absent, so that the amount of cool air to be sucked by the suction fan 4 must be increased to such a degree that the problem to which the present invention addresses does not arise. It is to be noted that even when the amount of air is increased, it flows through the space between the opposite runs of the belt 10 and therefore does not noticeably effect the other portions.

The illustrative embodiment is applicable to a monocolor copier, printer or facsimile apparatus in the same manner as to the color copier shown and described. Further, the illustrative embodiment is similarly practicable with an image forming apparatus of the type directly transferring toner images to a sheet being conveyed by an intermediate image transfer body, as taught in Laid-Open Publication No. 2002-91123 mentioned previously.

In summary, it will be seen that the present invention provides an image forming apparatus having various unprecedented advantages, as enumerated below.

(1) A module frame covers part of an intermediate image transfer body to thereby protect it from heat generated by fixing means during operation. Therefore, the temperature of the intermediate image transfer body and that of a developing device are prevented from rising. This insures high-quality images.

(2) The local temperature elevation of the intermediate image transfer body ascribable to temperature elevation around it is obviated, so that images are free from irregularity and horizontal stripes and other defects. In addition, the developing device is free from the influence of the above temperature elevation and obviates toner blocking and other undesirable occurrences.

(3) Double-wall heat shielding means forms an air layer between the intermediate image transfer body and the fixing means, effectively preventing heat generated by the fixing means from being transferred to the intermediate image transfer body.

(4) The heat shielding means is formed of a material having low thermal conductivity, further enhancing the heat insulating effect.

(5) A heat insulating material provided on the surface of the heat shielding means to further enhance the heat insulating effect of the heat shielding means while enhancing design freedom.

(6) Air around the intermediate image transfer body is replaced, so that the temperature elevation around the intermediate image transfer body is more effectively obviated.

(7) When the temperature inside the apparatus is apt to rise in a repeat copy mode, particularly repeat duplex copy mode, a suction fan is rotated at its maximum speed for thereby preventing the temperature inside the apparatus from rising.

Various modifications will become possible for those skilled in the art after receiving the teachings of the present disclosure without departing from the scope thereof.

What is claimed is:

1. An image forming apparatus comprising:

an image forming section configured to develop a latent image to thereby produce a corresponding toner image;

an endless image transfer body configured to directly or indirectly support the toner image thereby and convey said toner image;

fixing means for fixing the toner image;

a module frame configured to cover part of said image transfer body to thereby prevent heat generated by said fixing means from being transferred to said image transfer body; and a plate member intervening between said module frame and said fixing means.

2. An image forming apparatus as claimed in claim 1, wherein said plate member is provided in a body of the image forming apparatus.

3. An image forming apparatus as claimed in claim 2, wherein said module frame is configured to be pulled out of the body of the image forming apparatus together with said image transfer body.

4. An image forming apparatus as claimed in claim 1, wherein said plate member is configured to shield the heat generated by said fixing means.

5. An image forming apparatus as claimed in claim 1, wherein said plate member is configured to discharge the heat generated by said fixing means.

6. An image forming apparatus as claimed in claim 5, wherein said plate member is configured to be connected to a heat pipe.

7. An image forming apparatus comprising:

an image forming section configured to develop a latent image to thereby produce a corresponding toner image;

an endless image transfer body configured to directly or indirectly support the toner image thereby and convey said toner image;

a fixing device configured to fix the toner image;

a module frame configured to cover part of said image transfer body to thereby prevent heat generated by said fixing device from being transferred to said image transfer body; and a plate member intervening between said module frame and said fixing device.

8. An image forming apparatus as claimed in claim 7, wherein said plate member is provided in a body of the image forming apparatus.

9. An image forming apparatus as claimed in claim 8, wherein said module frame is configured to be pulled out of the body of the image forming apparatus together with said image transfer body.

10. An image forming apparatus as claimed in claim 7, wherein said plate member is configured to shield the heat generated by said fixing device.

11. An image forming apparatus as claimed in claim 7, wherein said plate member is configured to discharge the heat generated by said fixing device.

12. An image forming apparatus as claimed in claim 11, wherein said plate member is configured to be connected to a heat pipe.

* * * * *